United States Patent [19]

Berglund

[11] Patent Number: 4,765,514

[45] Date of Patent: Aug. 23, 1988

[54] CONTAINER

[76] Inventor: Albert I. Berglund, P.O. Box 61, Southold, N.Y. 11971

[21] Appl. No.: 1,298

[22] Filed: Jan. 8, 1987

[51] Int. Cl.[4] ..... A47G 19/14

[52] U.S. Cl. ..... 222/145; 222/466; 222/475; 220/94 A; 220/94 B; D9/380; D9/382

[58] Field of Search ..... 222/94, 145, 142.1, 222/465.1, 466, 475; 220/94 A, 94 B; 215/1 C, 6, 1 R, 100 A; D9/378, 380, 382, 383

[56] References Cited

U.S. PATENT DOCUMENTS

| | | | |
|---|---|---|---|
| D. 86,704 | 4/1932 | Delich | 222/142.1 |
| D. 195,599 | 7/1963 | Platte et al. | D9/382 |
| D. 216,248 | 12/1969 | Hills | D9/382 |
| D. 221,517 | 8/1971 | Luedtke | D9/382 |
| D. 224,200 | 7/1972 | Kretz . | |
| D. 265,291 | 7/1982 | Gould | D9/382 |
| D. 276,791 | 12/1984 | Field | D9/382 |
| 813,894 | 2/1906 | Holladay . | |
| 3,076,573 | 2/1963 | Thomas . | |
| 3,171,559 | 3/1965 | Ferree . | |
| 3,197,071 | 7/1965 | Kuster . | |
| 3,410,459 | 11/1968 | Conley . | |
| 3,443,710 | 5/1969 | Hills | D9/382 |
| 4,279,349 | 7/1981 | Aigner . | |
| 4,570,808 | 2/1986 | Campbell et al. | 220/94 A |

FOREIGN PATENT DOCUMENTS

| | | | |
|---|---|---|---|
| 940326 | 10/1963 | United Kingdom | 215/6 |

*Primary Examiner*—H. Grant Skaggs
*Attorney, Agent, or Firm*—Jordan and Hamburg

[57] ABSTRACT

A container is provided for storing and dispensing substances, especially fluids. The container is constructed with a lower chamber. A pair of elongated undulating channels extending upwardly and inwardly from the lower chamber merge at a throat section of the container having concave outer surfaces and define between them a hollow annulus at about the center of gravity of the container. The throat section merges with an upper chamber of the container. The upper chamber has a pair of oppositely-situated shoulder sections, each of which has an outer convex surface. The convex surfaces of the shoulder sections merge at a common upper plane of the container, where a neck opening and cap are provided. The elongated channels provide handles for grasping the containers at about its center of gravity and divide the flow from the lower chamber. The undulating flow path through the elongated channels, throat section and upper chamber, as well as the handles at the center of gravity, enable easy and sensitive flow control from the container. The hollow annulus can extend upwardly through the throat section and into the top chamber, dividing the throat section and top chamber in two, thus providing divided flow from the lower chamber to the top chamber and even more sensitive flow control. The container can also be divided in two by divider walls for containing two different substances.

5 Claims, 1 Drawing Sheet

FIG. 1
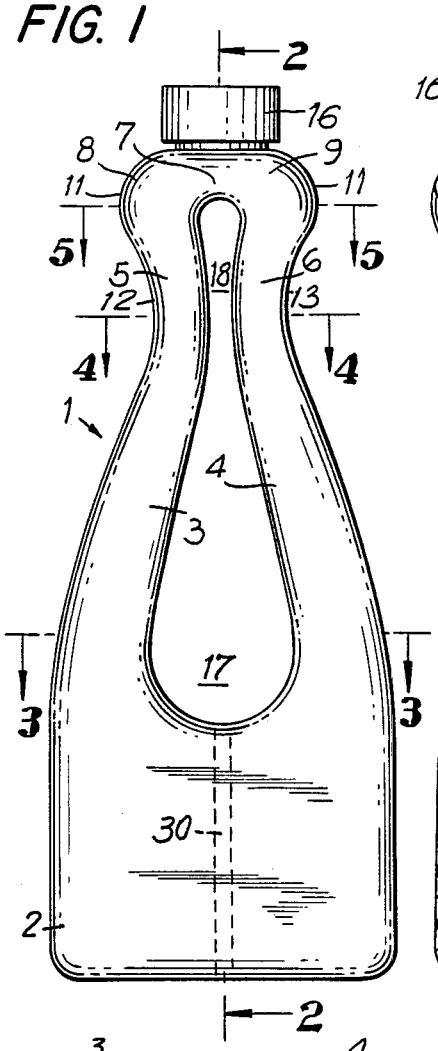
FIG. 2
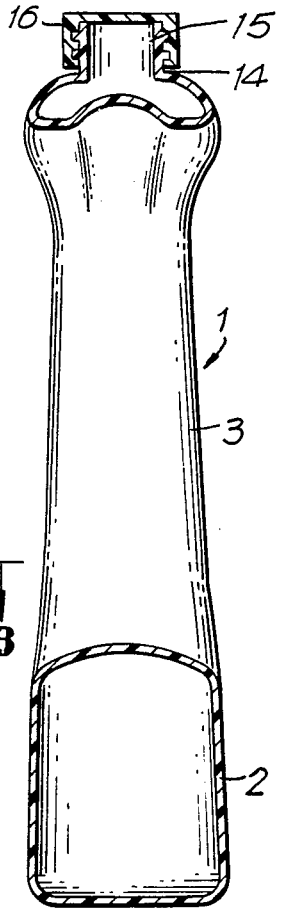
FIG. 6
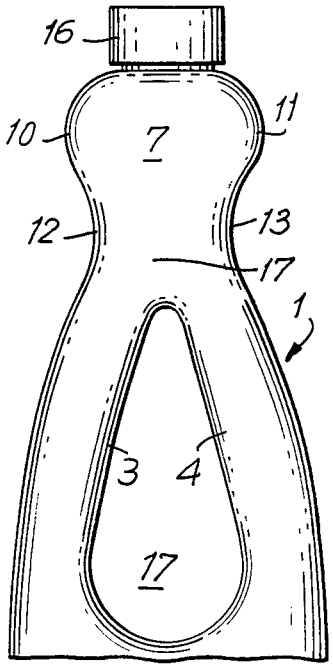
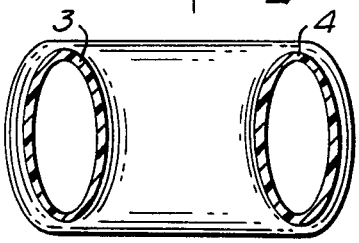
FIG. 3
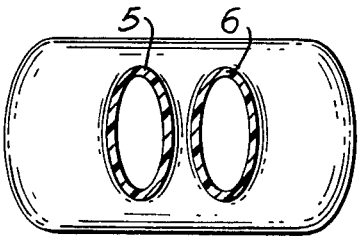
FIG. 4
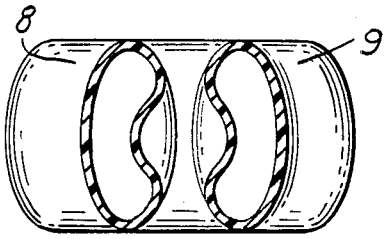
FIG. 5
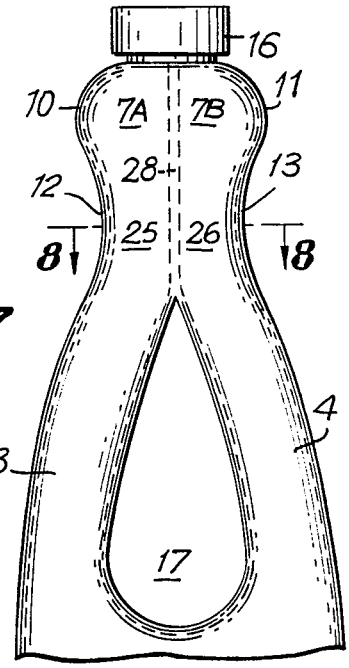
FIG. 7
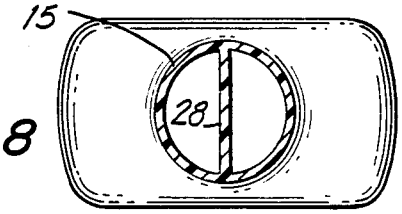
FIG. 8

CONTAINER

BACKGROUND OF THE INVENTION

The present invention relates to a container, and more particularly to a container especially suited for containing and dispensing fluids.

There are a great variety of containers for containing and dispensing substances, especially fluids. One such variety, exemplified by U.S. Pat. Nos. 3,410,459 and 3,443,710, has an opening in the upper portion of the container providing handles in the upper portion of the main body and thus eliminating the need for external handles appendaged to the main body. However, the design of such containers results in a lack of control over the fluid being dispensed from the container. Morever, especially in the case of large containers, these prior art containers require a great degree of strength to hold the container with one hand in a position to facilitate dispensing of the liquid therefrom. This further hinders the ability of a user to carefully control the dispensation of fluid.

Various design patents have been granted on container designs, but these containers are marked by the same drawbacks present in the above-mentioned utility patents. See, for example, U.S. Pat. Nos. Des. 195,599, 216,248, 224,200 and 265,291.

U.S. Pat. No. 4,570,808 discloses a baby bottle having an opening in the main body of the bottle at about the center of gravity of the bottle to facilitate a baby's holding on the bottle. Liquid is dispensed from a nipple on the bottle and no consideration is given to a construction which would facilitate handling and control of flow from the bottle through the opening of the bottle absent a nipple.

U.S. Pat. No. 4,279,349 discloses a container for storing and dispensing two different liquids. The interior of the container is compartmented and the compartments are separated further by an opening in the lower portion of the main body of the container. The container is grasped around the upper neck thereof. Control of liquid flow out of the container requires two hands and the conventional neck of the container results in a turbulent, uncontrollable flow.

Finally, various additional proposals have been made relating to containers for holding two different liquids therein. See, for example, U.S. Pat. Nos. 813,894, 3,076,573, 3,171,559 and 3,197,071 and British Pat. No. 940,326. However, all such proposed containers are characterized by awkward handling and lack of fine control of the liquid dispensed.

Accordingly, there is a need for a container for storing one or a plurality of substances, especially fluid substances, which is easy to handle and which provides fine, sensitive control over the substance being dispensed therefrom.

SUMMARY OF THE INVENTION

An object of the present invention is to provide a container having a handle formed as an integral part of the main body of the container and not as an appendage extending outwardly from the main body of the container.

A further object of the present invention is to provide a container having a handle formed as an integral part of the main body of the container which is convenient and easy to use and provides sensitivity in control of a substance and the amount of a substance to be dispensed from the container.

These and other objects are achieved, according to the present invention, by a container for storing and dispensing substances, especially fluids, comprising a lower chamber for containing a substance, a pair of elongated undulating channels extending upwardly and inwardly from the lower chamber and defining divided flow paths and a hollow annulus therebetween at about the center of gravity of the container, a throat section above the center of gravity of the container having concave outer surfaces, the pair of elongated undulating channels merging inwardly at the throat section, a top chamber merging with the throat section and having a pair of shoulder sections, each shoulder section having a convex outer surface, the convex outer surfaces merging at an upper common plane, a neck forming an opening at the upper common plane, and a cap for covering the opening.

Preferably, the hollow annulus extends upwardly through the throat section and into the upper chamber, dividing the throat section into a pair of throat portions, thus providing divided flow from the lower chamber through the pair of elongated chambers and pair of throat sections into the upper chamber. Alternatively, an upper divider wall extending upwardly through the throat section from the top of the hollow annulus and into the upper chamber can be provided for obtaining divided flow from the lower chamber to the upper chamber.

In another preferred embodiment, the container is segmented into two separate compartments for containing two different substances.

BRIEF DESCRIPTION OF THE DRAWINGS

The present invention will be better understood by reference to the accompanying drawings, in which:

FIG. 1 is a front plan view of one embodiment of a container according to the present invention;

FIG. 2 is a side sectional view taken along the line 2—2 of FIG. 1;

FIG. 3 is a cross-sectional view taken along the line 3—3 of FIG. 1;

FIG. 4 is a cross-sectional view taken along the line 4—4 of FIG. 1;

FIG. 5 is a cross-sectional view taken along the line 5—5 of FIG. 1;

FIG. 6 is a partial front plan view of a second embodiment of a container according to the present invention;

FIG. 7 is a partial front plan view of a third embodiment of a container according to the present invention; and FIG. 8 is a cross-sectional view taken along the line 8—8 of FIG. 7.

DETAILED DESCRIPTION OF THE PREFERRED EMBODIMENT

As shown in FIGS. 1 and 2, the container of the present invention, indicated generally at 1, has a lower chamber 2, a pair of elongated undulating channels 3 and 4, a throat section comprising two throat portions 5 and 6, and an upper chamber 7, all integrally formed. Each throat portion 5 and 6 has an outer concave surface 12 and 13, respectively. Upper chamber 7 includes a pair of shoulders 8 and 9, shoulders 8 and 9 each having an outer convex surface 10 and 11, respectively, forming functional depression therein. Convex surfaces 10 and 11 of shoulders 8 and 9 merge at a common upper plane 14, where a neck 15 of the container is formed. Neck 15 is threaded and is provided with a screw on cap 16 for sealing the container 1.

Elongated channels 3 and 4 define therebetween a hollow annulus 17 at about the center of gravity of the container. Throat portions 5 and 6 and shoulders 8 and 9 of upper chamber 7 define therebetween a hollow annulus extension 18 above the center of gravity of the container 1. Hollow annulus 17 and hollow annulus extension 18 are formed integrally with one another and define a vertically-elongated opening extending from lower chamber 2 to upper chamber 7 of container 1.

Elongated channels 3 and 4 constitute a pair of handles for grasping the container 1 at about the center of gravity of the container. Moreover, elongated channels 3 and 4, throat portions 5 and 6 and shoulders 8 and 9 provide for a divided flow path from lower chamber 2 to a point high in upper chamber 7. The undulating path of this divided flow, which can be seen in cross-section from FIGS. 3, 4 and 5, is through channels 3, 4, throat portions 5, 6 and shoulders 8, 9 into upper chamber 7, resulting in an undulating flow from the lower to upper chambers of the container.

In operation, tilting of the container 1 to dispense substance therein causes the substance to rise from one channel in an undulating flow through its respective throat portion and upper chamber shoulder out of the container through neck 15, while the substance in the other channel falls. In this manner, a balanced and sensitive control of the dispensing function is achieved.

The container illustrated in FIGS. 1 to 5 provides ease and efficiency for the user. Dual and uniform handles positioned near the center of gravity provide primary and secondary improvements in the control of the dispensing function. For example, the user is able to easily pick the container up from any position using either hand. Moreover, the creation of divided flow in the container results in improved control of the amount desired to be dispensed. Additionally, the undulating flow path provides better control of the substance contained. Further, shaped shoulders 8 and 9 act as functional depressions which serve to enhance the undulating flow from the channels 3, 4 and concave throat portions 5, 6 to the beginning point of neck 15, thus further facilitating a sensitive control of the dispensing function.

The container of the present invention can be made of a plastic material, preferably polyethylene, but can also be made of any other suitable material used conventionally for containers, such as glass or cardboard, or any combination of such materials.

The container of the present invention can be made using any of the many well-known techniques for manufacturing containers. For example, where the container material is a plastic material such as polyethylene, it can be made using blow molding or similar plastic molding techniques well-known in the art.

The hollow annulus of the container of the present invention is variable as to dimension, shape, elongation and location, to satisfy various dispensing requirements, as long as a portion of the hollow annulus is provided at about the center of gravity to form handles thereabout for grasping the container. The ability to hold the container at about the center of gravity results in easy handling and furthers the ability to sensitively control the dispensing function.

Divided flow is variably effected by changing the form of the hollow annulus to increase or decrease its vertical elongation so as to position the division of flow at a desired point high or low in the container 1. In the embodiment of FIG. 6, the divided flow paths merge at a lower point than in the embodiment of FIGS. 1 to 5 to create a functionally efficient flow for certain fluids.

As shown in FIG. 6, hollow annulus 17 is provided and hollow annulus extension 18 is omitted. A single throat section 17 is provided and the divided flows from channels 3 and 4 merge therein. Sensitivity of flow control is maintained via channels 3 and 4, throat section 17 with concave outer surfaces 12 and 13, and the shoulder sections 8 and 9 with convex outer surfaces 10 and 11 forming functional depressions in the shoulders.

In an alternative embodiment of the present invention, divided flow is provided to a point high in the container via a construction different from that of FIGS. 1 to 5.

As shown in FIGS. 7 and 8, hollow annulus extension 18 of the embodiment shown in FIGS. 1 to 5 is replaced by a divider wall 28 which extends vertically upwardly centrally from the top of hollow annulus 17 to the base of neck 15 of the container. Divider wall 28 divides the upper portion of the container 1 into separate throat sections 25 and 26 having, respectively, outer concave surfaces 12 and 13, and separate upper chambers 7A and 7B having shoulders with outer convex surfaces 10 and 11 forming functional depressions in the shoulders. This embodiment functions in a manner similar to that shown in FIGS. 1 to 5.

When a container according to the present invention is provided with a divided flow to a point high up in the container, as in the embodiments of FIGS. 1 to 5 and FIGS. 7 and 8, provisions can be made for the containment of two substances. As shown in FIG. 1, this is accomplished by a lower divider wall 30 which extends vertically and downwardly from the bottom of hollow annulus 17 and terminates at the bottom of the lower chamber 2 of container 1.

When a container according to the present invention is provided with a divided flow to a point high up in the container, as in the previously-described embodiments of FIGS. 1 to 5 and 7 and 8, tilting of the container to dispense the substance therein causes the substance to rise from one channel to dispense while causing the substance in the other channel to fall. This provides a balanced and sensitive control of the dispensing function.

It will be understood that the specification and preferred embodiments are illustrative but not limitative of the present invention. Other embodiments within the spirit and scope of the invention will suggest themselves to those skilled in the art.

What I claim is:

1. A container for storing and dispensing a substance, especially fluids, comprising:

means defining a lower chamber for containing the substance, said lower chamber including a bottom and a pair of side faces;

means defining a pair of elongated undulating channels extending upwardly and inwardly from the pair of side faces of said lower chamber, said pair of elongated channels defining divided flow paths and a hollow annulus therebetween at about the center of gravity of the container;

means defining a throat section above the center of gravity of said container, said throat section being narrower than said lower chamber and having concave outer surfaces, said pair of elongated channels merging inwardly at said throat section;

means defining an upper chamber in said container merging with said throat section, said upper chamber having a pair of shoulder sections, each shoulder section having a convex outer surface, the concave outer surfaces of said throat section flaring outwardly to merge with the convex outer surfaces of said shoulder sections, said convex outer surfaces merging at an upper common plane;

neck means defining an opening at the common plane where the convex outer surfaces of said pair of shoulder sections merge;

a cap for covering said opening, whereby said elongated channels additionally form a pair of handles for grasping the container; and said undulating channels, said throat section and said shoulder sections cooperating with said neck means to control the flow of substance through said neck means and out of said container when the container is tilted such that substance in the container flows from one of said channels in an undulating and controlled manner through said throat section and upper chamber and out of said container through said neck means while substance in the other of said channels falls towards said lower chamber.

2. A container as in claim 1 further comprises means defining an upper divider wall extending centrally and upwardly from the hollow annulus within and through said throat section and said upper chamber and terminating at said common plane, whereby divided flow is provided to said common plane.

3. A container as in claim 2, further comprising means defining a lower divider wall extending centrally and downwardly from the hollow annulus within and through said lower chamber to the bottom of said lower chamber, whereby said upper and lower divider walls and said hollow annulus separate said container into two compartments for containing two different substances.

4. A container as in claim 1, wherein said hollow annulus further comprises a hollow annulus extension extending upwardly through said throat section and terminating in said upper chamber, whereby said throat section is divided into first and second throat sections, each of the pair of elongated undulating channels merges inwardly with one of the first and second throat sections, each of the first and second throat sections merges outwardly with one of the pair of shoulder sections, and divided flow is provided from the lower chamber to the upper chamber of the container.

5. A container as in claim 4, further comprising means defining a lower divider wall extending centrally and downwardly from the hollow annulus through said lower chamber to the bottom of said lower chamber, whereby said hollow annulus extension, hollow annulus and lower divider wall separate said container into two compartments for containing two different substances.

* * * * *